US005737959A

United States Patent [19]

Korbel et al.

[11] Patent Number: 5,737,959

[45] Date of Patent: Apr. 14, 1998

[54] METHOD OF PLASTIC FORMING OF MATERIALS

[76] Inventors: Andrzej Korbel, u. Olkuska 8, PL-30-138 Krakow; Wlodzimierz Bochniak, u1. Pijarska 1/4a, PL-31-015 Krakow, both of Poland

[21] Appl. No.: 586,818

[22] PCT Filed: Apr. 7, 1996

[86] PCT No.: PCT/PL95/00006

§ 371 Date: Jan. 30, 1996

§ 102(e) Date: Jan. 30, 1996

[87] PCT Pub. No.: WO95/32818

PCT Pub. Date: Dec. 7, 1995

[30] Foreign Application Priority Data

| | | | |
|---|---|---|---|
| May 30, 1994 | [PL] | Poland | 303571 |
| Aug. 2, 1994 | [PL] | Poland | 304546 |
| Oct. 3, 1994 | [PL] | Poland | 305305 |

[51] Int. Cl.[6] ..... B21D 31/00; B21C 23/00

[52] U.S. Cl. ..... 72/362; 72/366.2; 72/256

[58] Field of Search ..... 72/68, 256, 366.2, 72/377, 350

[56] References Cited

U.S. PATENT DOCUMENTS

| | | | |
|---|---|---|---|
| 3,839,890 | 10/1974 | Phlippoteau | 72/68 |
| 3,879,974 | 4/1975 | Biddell et al. | 72/350 |
| 4,300,378 | 11/1981 | Thiruvarudchelvan | 72/256 |
| 4,627,260 | 12/1986 | Benz | 72/250 |

FOREIGN PATENT DOCUMENTS

| | | | |
|---|---|---|---|
| 1-262001 | 10/1989 | Japan | 72/250 |

*Primary Examiner*—Lowell A. Larson
*Assistant Examiner*—Rodney Butler
*Attorney, Agent, or Firm*—Dennison, Meserole, Pollack & Scheiner

[57] ABSTRACT

An improvement to a method for plastic forming of a material by rolling, forging or extrusion, by using a tool to exert a force on the material to obtain a product of desired geometry. The improvement comprises inducing in the material a reversible plastic strain in the form of shear bands localized in a zone of most intense deformation by the tool, by introducing a motion of the tool additional to a tool working motion which produces the desired geometry. The additional motion is reversible and transfers motion to the material due to intimate contact between the material and the tool.

7 Claims, 4 Drawing Sheets

METHOD OF PLASTIC FORMING OF MATERIALS

DESCRIPTION

1. Field of the Invention

The invention relates to a method of plastic forming of solid materials, in particular metallic and powdered materials or materials containing a powdered fraction. The method, according to the invention, can find application especially during rolling, forging and extrusion, although it is applicable in other types of plastic working.

2. Description of Related Art

The widely known method of rolling metal products in the form of ingots, sheets and strips consists in letting them pass between rolls situated in parallel and rotating around their axes. This method is realized by means of rolling mills of various types, in which the reduction of the thickness of the rolled product depends on the spacing between the working rolls. The disadvantage of this method is great energy consumption since obtaining large deformations involves the application of considerable force. This is especially important when thin metal foils are being rolled, considering that the thinner the rolled material the higher is the energy loss in the rolling process.

The widely known stamping methods are the open die forging and die forging which consist in exerting a pressure on the material by the shaping tools advancing in a plane motion to obtain a product of the desired shape. Forging by these methods does not necessarily guarantee that the desired large deformations of the product will be obtained, especially when hardly deformable materials are subjected to plastic working, and, moreover, it requires the use of considerable force. From the Polish patent application No P - 295 135, a method of reducing the forging force is known in which, in the course of forging, the working tools or their active parts are turned or shifted with respect to the material or the material is turned or shifted with respect to the shaping tools or their active parts in a direction perpendicular, or having a component perpendicular to the direction of forging. However, in this method, there takes place a slip when the working tool comes into contact with the material.

Widely known is the direct method of extrusion of metallic products, which consists in plane pushing out of the extruded material through an immovable matrix in order to reduce its cross-section. Another known method is the backward extrusion in which the extruded material is not moved and the extrusion process is performed through plane motion of the matrix towards the material. Both these methods involve considerable energy consumption.

Another method of material extrusion is known from the Polish patent application No P - 295 057, in which during extrusion the material is turned or shifted with respect to the matrix or the matrix or its parts are turned or shifted with respect to the material. The direction of the motion lies advantageously in a plane perpendicular to the direction of extrusion. In this method there takes place a slip, where the matrix comes into contact with the extruded product.

SUMMARY OF THE INVENTION

The object of the invention is to provide the intrusion into the structure of the material deformed during plastic working, thus changing the course of its plastic flow by inducing in the material additional reversible plastic strain in the form of shear bands localized in the zone or zones of the most intense deformation of the material, resulting from the method of plastic working. The mentioned additional plastic strain is not necessary from the point of view of the geometry of the worked product. The intrusion into the structure of the material undergoing deformation offers the advantage of introducing additional motion of at least one tool in a direction other than that of the working motion, the structure of the tool necessitating the transfer of the mentioned additional motion of the tool to the inside of the worked material. This transfer is due to intimate contact of the material with the tool in an advantageous way by introducing developed contact areas between the tool and the material.

In the method, proposed in the invention, contrary to the known methods, the friction between the material and the tool is made maximal.

A change in the plastic flow of the material is also possible through cyclic changes of temperature, thus inducing the destabilization of the structure and, as a consequence, the externally forced localization of strain in the form of shear bands.

By inducing a change in the course of plastic flow of the material during rolling, additional plastic deformation of the product is forced in the shear bands through reversible turning of the rotational axis of at least one of the rolls, with its roll axis situated in a plane perpendicular to the rolling direction and, advantageously, the reversible turning of the roll axis whose working part has a spherical or nearly spherical shape, with respect to the other roll, the working part of which has a shape compatible with that of the first roll.

By inducing a change in the plastic flow of the material during forging additional plastic deformation is forced in the shear bands through cyclic torsion of the operating tool or of its part together with the part of the product in close contact with it, or through cyclic torsion of the part of the product with respect to its part being in intimate contact with the tool, the operating tools having a developed contact surface with the product.

In another version of the method by inducing a change in the plastic flow of the material during forging additional plastic deformation of the product is forced in the shear bands through cyclic shifting of the operating tool or of its part together with a part of the product in contact with it, with respect to the remaining part of the product, in a direction other than the direction of forging, or by cyclic shifting of a part of the product with respect to the remaining part of the product in contact with the operating tool, in a direction different from the direction of forging, the operating tools having a developed contact surface with the product.

By inducing a change in the plastic flow of the material, in the course of extruding the product, a periodically changed turning of the matrix or of its component part together with the part of the product being in close contact with its, is introduced with respect to the remaining part of the product placed in the recipient, or through periodically changed turning of the part of the product situated in the recipient with respect to the remaining part of the product in close contact with the matrix from the side of the recipient, and the matrix from the side of the recipient having a developed contact surface with the product undergoing extrusion.

In another version of the method, the induced change in the plastic flow of the material in the course of extruding the product is caused by periodically changed shifting of the matrix or of its component element together with the part of the product in close contact with it in a direction other than the extrusion direction, with respect to the remaining part of the product placed in the recipient, or through periodically changed shifting of a part of the extruded product situated in the recipient with respect to the remaining part of the product in close contact with the matrix from the side of the recipient and the matrix from the side of the recipient having a developed contact surface with the extruded product.

Intrusion by the method according to the invention into the material structure without changing the shape and dimensions of the product offers the reduction of the energy required to obtain the desired deformation in various operations of plastic working. The advantage of the proposed solution according to the invention, besides the possibility to obtain large deformations, is thus also the reduction of the force and of the temperature of the process.

BRIEF DESCRIPTION OF DRAWINGS

The solution as proposed by the invention will be explained by means of figures and illustrative examples. The particular figures represent.

DESCRIPTION OF THE PREFERRED EMBODIMENTS

Figure 1:
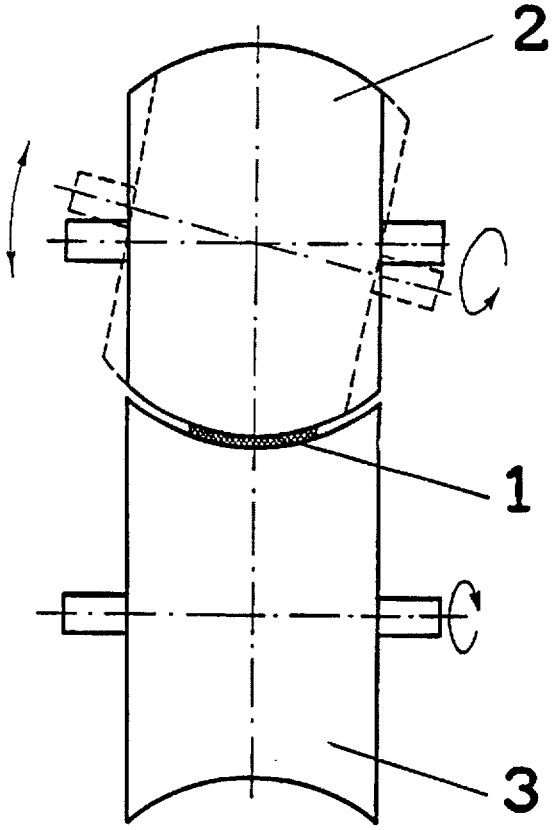
FIG. 1—Schematic diagram of the sheet rolling process with the application of reversible torsion of the roll axis, FIG. 2—Schematic diagram of the forging process with the application of reversible torsion of the punch, FIG. 3—Schematic diagram of the forging process with the application of reversible motion of the anvil, FIG. 4—Schematic diagram of the extrusion process with the application of a rotating matrix, FIG. 5—The same process as in FIG. 4 with the application of a rotating recipient, FIG. 6—The extrusion process with the application of a matrix shifting in a direction perpendicular to the extrusion directron.

To realize the rolling process of the material 1 by the method according to the invention, the roll mill, shown in FIG. 1, with a spherical roll 2 and a concave roll 3 of a shape fitting that of roll 2, is used.

The rolled material 1 is placed between the rolls 2 and 3. The spherical roll 1 makes an additional reversible torsional movement in a plane perpendicular to the rolling direction.

Figure 2:
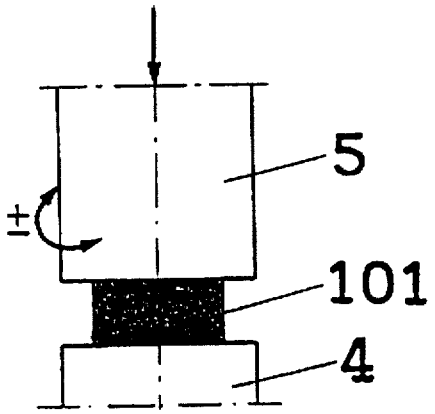

In the forging process realized according to the invention and shown in FIG. 2, the forged product 101, placed on an immovable anvil 4, is subjected to the action of the punch 5, moving in a plane motion in the direction of the anvil 4.

The anvil 4 and the punch 5 have developed contact surfaces with the object 101. In the course of forging a reversible torsion of the punch 5 together with the part of the product in close contact with it, is forced with respect to the remaining part of the product contacting the anvil 4, which causes additional deformation of the forged product 101.

Figure 3:
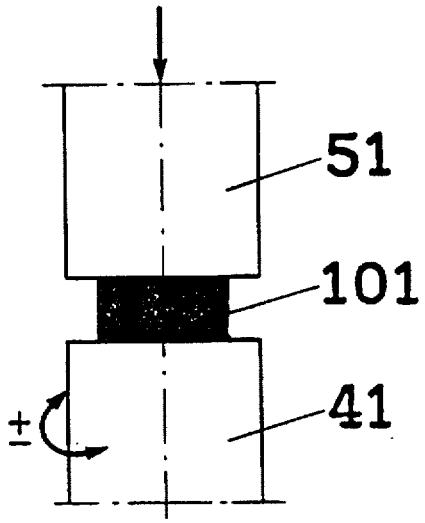
Figure 4:
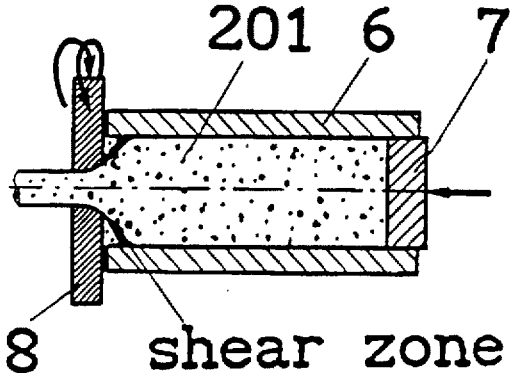

In another version, shown in FIG. 3, the anvil 41 together with the part of the product 101 in contact with the anvil 41 is brought into reversible-torsional motion. The punch 51 performs only a plane montion towards the anvil 41. In other possible versions of forging the torsional motion is replaced by a plane motion in a plane perpendicular to the forging direction.

The installations shown in FIGS. 4–7 are used to carry out the extrusion process.

The extruded product 201 placed in an immovable recipient 6 is subjected to the action of the punch 7, making a plane motion towards the matrix 8. Simultaneously, a reversible torsion of the matrix 8 together with a part of the product 201 in contact with it from the side of the recipient 6 is forced. The matrix 8 has a developed front surface from the side of the recipient 6 in the form of grooves in the surface which provides close adherence of the part of the extruded product 201 to it. In the shear zone of the extruded product 201 additional plastic strain is forced through cyclic torsion of the product 201.

Figure 5:
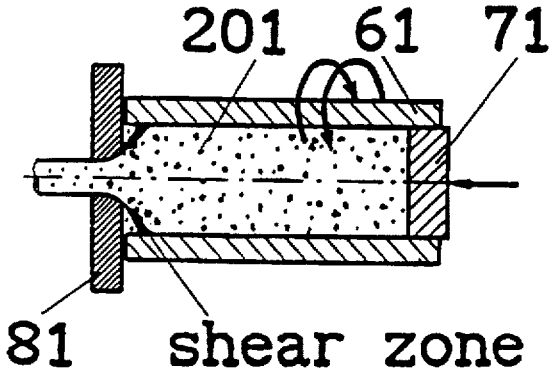

In the case illustrated in FIG. 5, the recipient 61, together with a part of the product 201 placed in it, is brought into reversible-torsional motion. The matrix 81 together with a part of the product 201 in contact with it is immovable. As a result, in the shear zone of the extruded product 201, additional plastic strain is induced.

In the backward extrusion method the plane motion of the punch 7 or 71 is replaced by the plane motion of the matrix 8 or 81 pushing out the extruded product through its hole.

Figure 6:
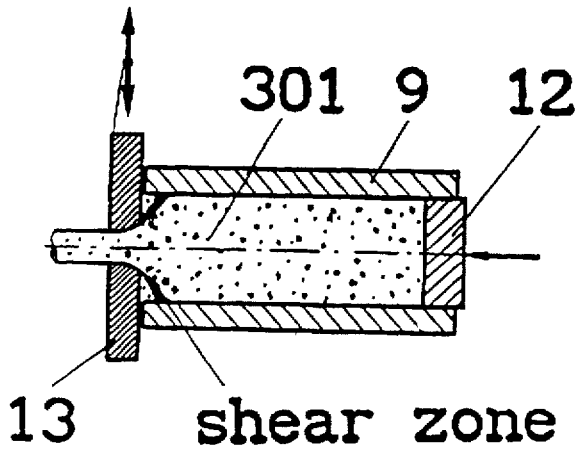
Figure 7:
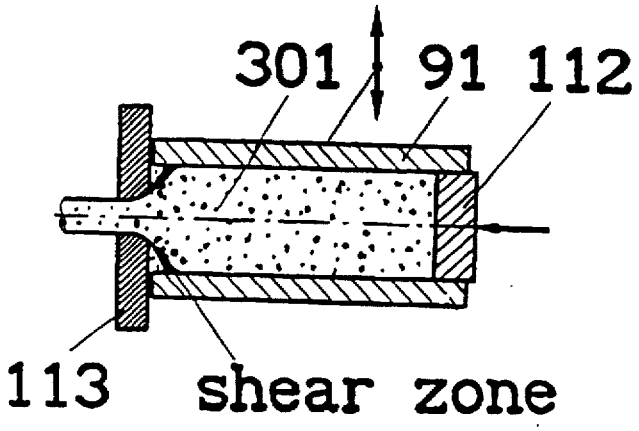
FIG. 7—The extrusion process with the application of a recipient shifting in a direction perpendicular to the extrusion direction.

In another example of the application of the invention, shown in FIG. 6, the extruded product 301 is placed in the recipient 9 and subjected to the action of the punch 12. While the product 301 is being pushed through a hole in the matrix 13, that is characterized by a developed front surface from the side of the recipient 9, the matrix 13, together with the part of the product 301 in close contact with it from the side of the recipient 9, is brought into cyclic reciprocating motion, the direction of this motion being perpendicular to the extrusion direction. In the shear zone of the extruded product 301 additional plastic strain is forced. In the case illustrated in FIG. 7, the recipient 91 together with the part of the product 301 placed in it and subjected to the action of the punch 112 is brought into reciprocating motion, while the matrix 113 together with the part of the product contacting it from the side of the recipient 91, is made immovable.

INDUSTRIAL APPLICABILITY

To illustrate the method described in the invention examples are given of plastic forming of materials using different methods.

EXAMPLE 1 (ROLLING)

Aluminium sheet 2 mm thick and 10 mm wide was rolled at 60% reduction in a roll mill having one spherical roll of 100 mm diameter and another one with its shape fitting that of the first roll, rotating at a speed of 1 rotation per sec, applying additional reversible turning of the spherical roll in a plane perpendicular to the rolling direction, with a frequency 10 Hz and the amplitude ±3°. The quality of the sheet obtained by the method according to the invention was satisfactory and the total rolling force was 300N. Rolling without additional deformation produced by reversible turning of the spherical roll resulted in the sheet cracking, and the total force of rolling amounted to 640N.

EXAMPLE 2 (FORGING)

A roll sample of 7 mm diameter and a height of 8.4 mm, obtained from 0.6% low-carbon steel, was subjected to forging at a rate of 0.1 cm/min, simultaneously forcing additional deformation of the sample through reversible torsion of one of the operating tools (anvil with developed contact surface with the product) together with a part of the material in close contact, with a frequency of 1 Hz and the amplitude ±10°.

At 80% deformation the force was equal to 3.1 kN, and the sample did not reveal any trace of damage. An identical sample forged by the standard method was destroyed—showing cracks—after 64% deformation with the forging force equal to 6.8 kN.

EXAMPLE 3 (FORGING)

A roll sample of 7 mm diameter and a height of 8.4 mm, obtained from 0.6% low-carbon steel, was subjected to forging at a rate of 0.1 cm/min, simultaneously forcing additional deformation of the sample through reversible cyclic shifting of one of the shaping tools (anvil with developed contact surface with the product) together with a part of the product adjoining it, at the frequency 8 Hz and the amplitude ±0.1 mm.

At 80% deformation the force was equal to 3.6 kN, and the sample did not show any traces of damage. An identical sample forged by the standard method was destroyed, undergoing cracking, after 64% deformation with the forging force equal to 6.8 kN.

EXAMPLE 4 (EXTRUSION)

A lead ingot of 45 mm diameter was subjected to backward extrusion at a rate of 2 mm/sec, at room temperature and the extrusion ratio $\lambda$=56. The extrusion force was 535 kN.

Application of a matrix turning reversibly with respect to its axis together with the part of the ingot adjoining it, in relation to the remaining part of the ingot at the frequency 10 Hz and the amplitude ±8°30', made possible the extrusion with a force equal to 205 KN.

EXAMPLE 5 (EXTRUSION)

A lead ingot of 45 mm diameter was subjected to backward extrusion at a rate of 2 mm/sec, at room temperature and the extrusion ratio $\lambda$=56. The extrusion force was 535 kN. Application of a matrix shifting reversibly in plane perpendicular to the extrusion direction, with rectilinear, reciprocating motion, together with the ingot part adjoining it, at the frequency 10 Hz and the amplitude ±0.5 mm made it possible to carry out the extrusion process with a force equal to 320 kN.

The method proposed by the invention may be also used in practice in other processes of plastic working, for example conform or exrolling, which is illustrated by the successive example.

EXAMPLE 6 (EXROLLING)

Aluminium rod, 7.2 mm in diameter, hardened by drawing at 50% cross-section reduction, was cold reduced in a rolling mill with rolls of 260 mm diameter and calibers ensuring a circular clearance of 6.5 mm diameter, in which the extrusion matrix was situated, of developed active surface, with the external diameter of 6.5 mm, and the inside diameter of 2.5 mm, cyclically twisted with respect to its axis by an angle of ±10°, at the frequency 15 Hz, and the rotation speed of the calibrated rolls equal to 1 $s^{-1}$. A wire obtained in result of such a process showed mechanical properties equivalent to those of a wire obtained by the method of multi-stage drawing with the necessary annealing between the operations. Repeated attemps to produce a wire using the same installation but without the cyclic torsion of the matrix failed.

EXAMPLE 7 (POWDER COMPRESSION)

Aluminium powder was compressed in a closed container with a punch shifting towards the inside, applying increasing unit pressure up to 200 MPa and reversible twisting of the compressing punch of a developed contact surface with the powdered material by an angle of ±18°, at the frequency 5 Hz. A monolithic product of a density 2.68×10 kG/$m^3$ was obtained. Compression without additional twisting of the compressing punch gave a product of a density 2.52×10 kG/$m^3$.

The cases presented above do not limit the possibilities of realizing the invention, being only illustrative examples. The invention may be also realized, in particular through cyclic temperature changes of the worked material.

What is claimed is:

1. In a method for plastic forming of a material by rolling, forging or extrusion by using a tool to exert a force on the material to obtain a product of desired geometry, the improvement comprising inducing in the material a reversible plastic strain in the form of shear bands localized in a zone of most intense deformation by the tool, by introducing a motion of said tool additional to a tool working motion which produces the desired geometry, said additional motion periodically reversing and transferring motion within the material due to intimate contact between the material and the tool, said additional motion intruding into the structure of the deformed material and changing plastic flow thereof.

2. The method of claim 1, wherein the material is deformed by rolling between a pair of rolls, one of said pair of rolls having a concave surface and the other of said pair of rolls having a corresponding convex surface, at least one of said rolls reversibly moving on a rotational axis which is perpendicular to its longitudinal axis in order to force the material into shear bands.

3. The method of claim 1, wherein the material is deformed by forging between an operating tool and a support, with cyclic torsion of the operating tool or the support forcing the material into shear bands.

4. The method of claim 1, wherein the material is deformed by forging between a shaping tool and a support, with reversible advancing of the shaping tool or the support in a planar motion in a direction different from a forging direction or cyclic shifting of a part of the material with respect to another part of the material in intimate contact with the shaping tool in a direction different from a direction of forging, to force the material into shear bands.

5. The method of claim 1, wherein the material is deformed by extruding from a source through a die, by periodically reversibly twisting a portion of the material by periodically reversibly twisting the source or the die, resulting in additional plastic deformation in a shear zone.

6. The method of claim 1, wherein the material is deformed by extruding from a source through a die, by periodically reversibly shifting a part of the material in a planar motion in a direction other than a direction of extrusion, by periodically reversibly shifting the source or the die, resulting in additional plastic deformation in a shear zone.

7. The method of claim 1, wherein the material is a powder.

* * * * *